US007812287B2

(12) United States Patent
Kruempelmann et al.

(10) Patent No.: US 7,812,287 B2
(45) Date of Patent: Oct. 12, 2010

(54) METHOD FOR CONTROLLING A PYROLYSIS CLEANING PROCESS IN AN OVEN

(75) Inventors: Thomas Kruempelmann, Guetersloh (DE); Juergen Scharmann, Herzebrock-Clarholz (DE); Ulrich Sillmen, Guetersloh (DE)

(73) Assignee: Miele & Cie. KG, Guetersloh (DE)

( * ) Notice: Subject to any disclaimer, the term of this patent is extended or adjusted under 35 U.S.C. 154(b) by 875 days.

(21) Appl. No.: 11/688,371

(22) Filed: Mar. 20, 2007

(65) Prior Publication Data

US 2007/0217952 A1 Sep. 20, 2007

(30) Foreign Application Priority Data

Mar. 20, 2006 (DE) ..... 10 2006 013 093

(51) Int. Cl.
*A21B 1/00* (2006.01)
*G01N 31/12* (2006.01)

(52) U.S. Cl. ..... 219/413; 219/412; 219/391; 219/501; 219/497; 219/395; 219/396; 219/397; 219/398; 219/393; 422/78

(58) Field of Classification Search ..... 219/413–3, 219/391–2, 497, 501, 395–8, 393; 422/78
See application file for complete search history.

(56) References Cited

U.S. PATENT DOCUMENTS

| | | | |
|---|---|---|---|
| 4,481,404 | A | 11/1984 | Thomas et al. |
| 4,496,817 | A | 1/1985 | Smith |
| 4,954,694 | A | 9/1990 | Nagai et al. |

FOREIGN PATENT DOCUMENTS

| | | |
|---|---|---|
| DE | 41 27 390 | 2/1993 |
| DE | 197 06 186 | 8/1998 |
| EP | 0 380 733 | 8/1990 |
| EP | 1 172 613 | 1/2002 |

*Primary Examiner*—Shawntina Fuqua
(74) *Attorney, Agent, or Firm*—Leydig, Voit & Mayer, Ltd.

(57) ABSTRACT

A method for controlling a pyrolysis cleaning process in an oven includes the steps: a) heating an oven cavity of the oven by switching on a heat source; b) measuring, using an oxygen sensor, an oxygen concentration in the oven cavity or in an exhaust-air conduit configured to discharge fumes from the oven cavity; c) comparing, in an evaluation circuitry of an electrical control unit, the measured oxygen concentration to a predefined limit value stored in a memory; d) operating, if the measured oxygen concentration drops below the limit value, the oven for a predefined first time interval with the heat source switched off, a duration of the first time interval being stored in the memory; and e) repeating steps b) through d) after the first time interval has ended; or f) repeating steps a) through d) if the measured oxygen concentration is equal to or greater than the limit value.

8 Claims, 2 Drawing Sheets

METHOD FOR CONTROLLING A PYROLYSIS CLEANING PROCESS IN AN OVEN

Priority is claimed to German patent application DE 10 2006 013 093.6, filed Mar. 20, 2006, which is hereby incorporated by reference herein.

The invention relates to a method to control a pyrolysis cleaning procedure in an oven.

BACKGROUND

U.S. Pat. No. 4,481,404 describes a method to control a pyrolysis cleaning procedure in an oven, said method making use of a gas sensor that responds to the smoke gases generated during the pyrolysis. As soon as the gas sensor detects an excessively high concentration of smoke gas, the heating power of the oven cavity heater is lowered in order to reduce the amount of smoke gas. When the smoke gas concentration then drops to below the critical value, the oven cavity heater is once again supplied with the full heating power. This approach serves to avoid overloading of the oxidation catalyst. The employed gas sensor and the evaluation of its output signals have to be adapted to the type of oven in question.

U.S. Pat. No. 4,954,694 describes a method to automatically end a pyrolysis cleaning procedure in an oven whereby, after the heat source has been switched on, the oxygen concentration in an exhaust-air conduit is measured and the duration of the pyrolysis procedure is determined on the basis of the course of the measured values.

Furthermore, German patent application DE 197 06 186 A1 describes a method in which the temperature of the catalyst is measured by means of a temperature sensor. When a certain temperature threshold value, corresponding to a certain amount of smoke gas, is exceeded, the heater that serves to heat the oven cavity is switched off. The heater is only switched on again once the catalyst temperature has dropped below a threshold value.

SUMMARY

Consequently, the present invention deals with the problem of providing a method to control a pyrolysis cleaning procedure in an oven with which method a high degree of measuring precision is achieved and which can be employed in many different types of ovens.

The present invention provides a method for controlling a pyrolysis cleaning process in an oven. The method includes the following steps:

a) heating an oven cavity of the oven by switching on a heat source;

b) measuring, using an oxygen sensor, an oxygen concentration in the oven cavity or in an exhaust-air conduit configured to discharge fumes from the oven cavity;

c) comparing, in an evaluation circuitry of an electrical control unit, the measured oxygen concentration to a predefined limit value stored in a memory;

d) operating, if the measured oxygen concentration drops below the limit value, the oven for a predefined first time interval with the heat source switched off, a duration of the first time interval being stored in the memory; and e) repeating steps b) through d) after the first time interval has ended; or f) repeating steps a) through d) if the measured oxygen concentration is equal to or greater than the limit value.

BRIEF DESCRIPTION OF THE DRAWINGS

An embodiment of the invention is shown schematically in the drawings and will be described in greater detail below. The drawings show the following.

DETAILED DESCRIPTION

Figure 1:
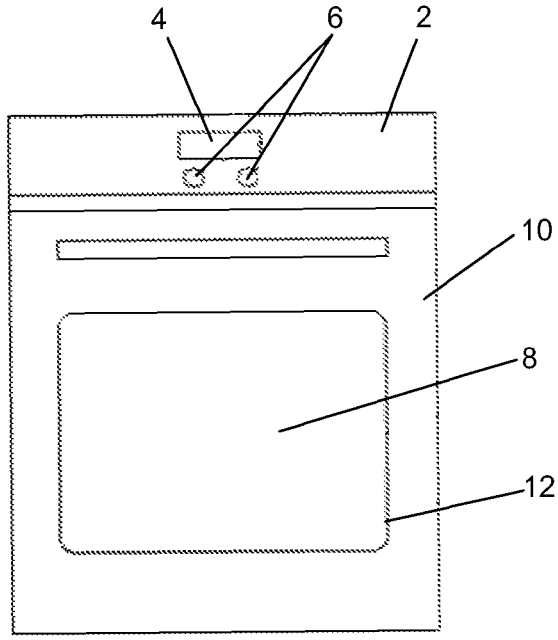
FIG. 1—a frontal view of an oven in which the method according to the invention is used.

Advantages that can be achieved with the invention include the fact that a high degree of measuring precision can be achieved and in that the method can be employed in many different types of ovens. By measuring and evaluating the oxygen concentration, the gas sensor, which is configured as an oxygen sensor, can be re-calibrated without too much effort and independently of operating the oven or performing the pyrolysis. There is no need for an adaptation to different types of ovens or to gas sensors having varying sensitivities to different gases. Instead, a simple method having a high precision is put forward here that allows a high-quality pyrolysis and thus a satisfactory cleaning result. Another advantage is that a fixed time interval I can be used so that the heat source that heats the oven cavity can be switched off when the oxygen concentration is too low. As a result, the oxygen concentration can be measured constantly at discrete time intervals rather than continuously, thus accounting for simpler evaluation and switching technology as well as for less energy consumption. All in all, the use of the method according to the invention translates into time and energy savings for the pyrolysis cleaning procedure.

An advantageous refinement proposes for the heat source used to heat the oven cavity to be alternatingly switched on during predefined first intervals $I_1$ that are stored in the memory, and then to be switched off during second time intervals $I_2$, whereby the duration of the time interval I is the same as the duration of the second time interval $I_2$. As a result, the method according to the invention can be realized in a particularly simple manner.

As a matter of principle, the limit value GW for the oxygen concentration can be selected over a wide suitable range. Advantageously, the limit value GW for the oxygen concentration is about 18 vol-%.

Fundamentally, the method according to the invention can be employed during the entire pyrolysis cleaning procedure. As a result, during the entire pyrolysis procedure, the pyrolysis can be performed at the lowest limit for the oxygen concentration, limit value GW, that is still permissible for attaining a complete pyrolytic reaction of the smoke gases generated during the pyrolysis, so that the shortest possible pyrolysis duration and the lowest possible energy consumption can be achieved.

Advantageously, the pyrolysis cleaning procedure comprises three phases, namely, a heating phase until a pyrolysis temperature $T_P$ in the oven cavity has been reached that is either predefined or else automatically determined during the heating phase; a holding phase whose duration corresponds to a time interval $I_3$ that is either predefined or else automatically determined during the heating phase and during which the pyrolysis temperature $T_P$ is kept essentially constant through temperature regulation; and a cooling phase to reach a predefined final temperature in the oven cavity, whereby the process steps a) through f) listed in claim 1 are only carried out during the heating phase. In this manner, the subsequent pyrolysis phases, especially the holding phase, can be optimized as a function of the oxygen concentration determined during the heating phase and as a function of the resulting switching-off cycles of the heat source, said optimization relating to the duration of the phase in question as well as to the temperature in the oven cavity during this phase.

An especially simple realization of the above-mentioned embodiment proposes for the duration of the holding phase $I_3$ and/or the value of the pyrolysis temperature $T_P$ in the oven cavity during the holding phase $I_3$ to be automatically determined in the evaluation circuitry as a function of the number of times the heat source was switched off during the heating phase because the oxygen concentration was too low.

Another advantageous refinement of this embodiment proposes for the duration of the holding phase $I_3$ and/or the value of the pyrolysis temperature $T_P$ in the oven cavity during the holding phase $I_3$ to be automatically determined in the evaluation circuitry as a function of the average oven cavity temperature during the time interval $I_4$, namely, from the first time the heat source was switched off because the oxygen concentration was too low until the end of the last time the heat source was switched off because the oxygen concentration was too low. This improves the precision of the method.

Another alternative refinement proposes for the duration of the holding phase $I_3$ and/or the value of the pyrolysis temperature $T_P$ in the oven cavity during the holding phase $I_3$ to be automatically determined in the evaluation circuitry as a function of the sum of the times when the heat source was switched off during the heating phase because the oxygen concentration was too low. This further improves the precision of the method.

An advantageous refinement of the latter embodiment proposes for the duration of the holding phase $I_3$ to be determined in the evaluation circuitry in that the sum of the times when the heat source was switched off because the oxygen concentration was too low is added to a minimum duration $I_{3_MIN}$ that was predefined and stored in the memory. This constitutes a particularly simple implementation of the method.

FIG. 1 shows an oven in which the method according to the invention is used. The oven has an operating panel 2 with a display 4 and operating elements 5. The oven cavity 8 can be closed with a door 10, said door 10 having a viewing window 12.

Figure 2:
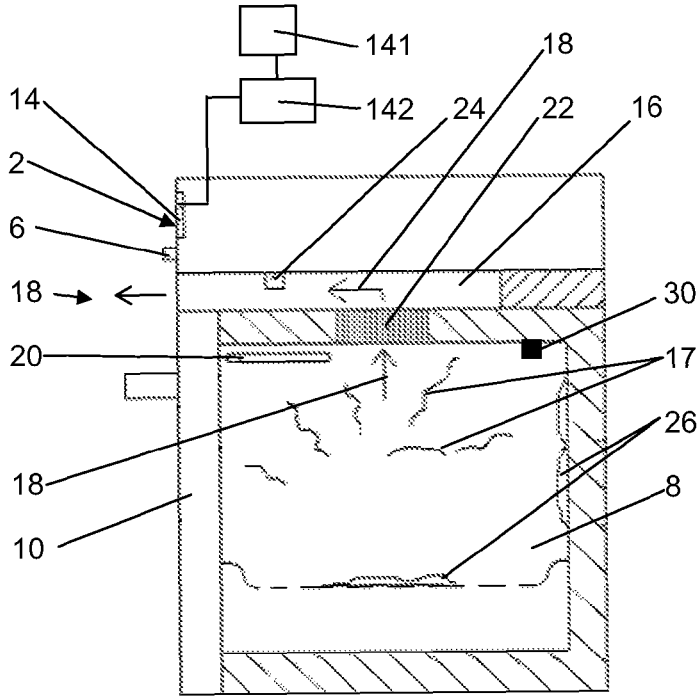
FIG. 2—a sectional view of the oven from FIG. 1.

FIG. 2 shows the oven in a sectional view from the side. Behind the operating panel 2, the oven has an electrical control unit 14. The smoke gases generated in the oven cavity 8 during the pyrolysis procedure, the so-called fumes, can be discharged into the atmosphere via an exhaust-air conduit 16. The path of the smoke gases 17 here is indicated by arrows 18. The oven cavity 8 has a heat source 20 configured as an electric radiant heater that serves to heat said oven cavity 8. An oxidation catalyst 22 is arranged between the oven cavity 8 and the exhaust-air conduit 16 and this is where the smoke gases 17 discharged via the exhaust-air conduit 16 are reacted in a manner known to the person skilled in the art. An oxygen sensor 24 that serves to determine the oxygen concentration is arranged in the exhaust-air conduit 16 downstream from the oxidation catalyst 22. In a manner known to the person skilled in the art, the above-mentioned parts are connected to the electrical control unit 14 so as to transmit signals.

Diverging from the embodiment explained here, the oxygen sensor 24 can also be arranged at a different suitable place in the oven. The same applies to the oxidation catalyst 22 which can also be arranged, for instance, in the exhaust-air conduit 16.

The method according to the invention will now be explained with reference to FIG. 3.

Figure 3:
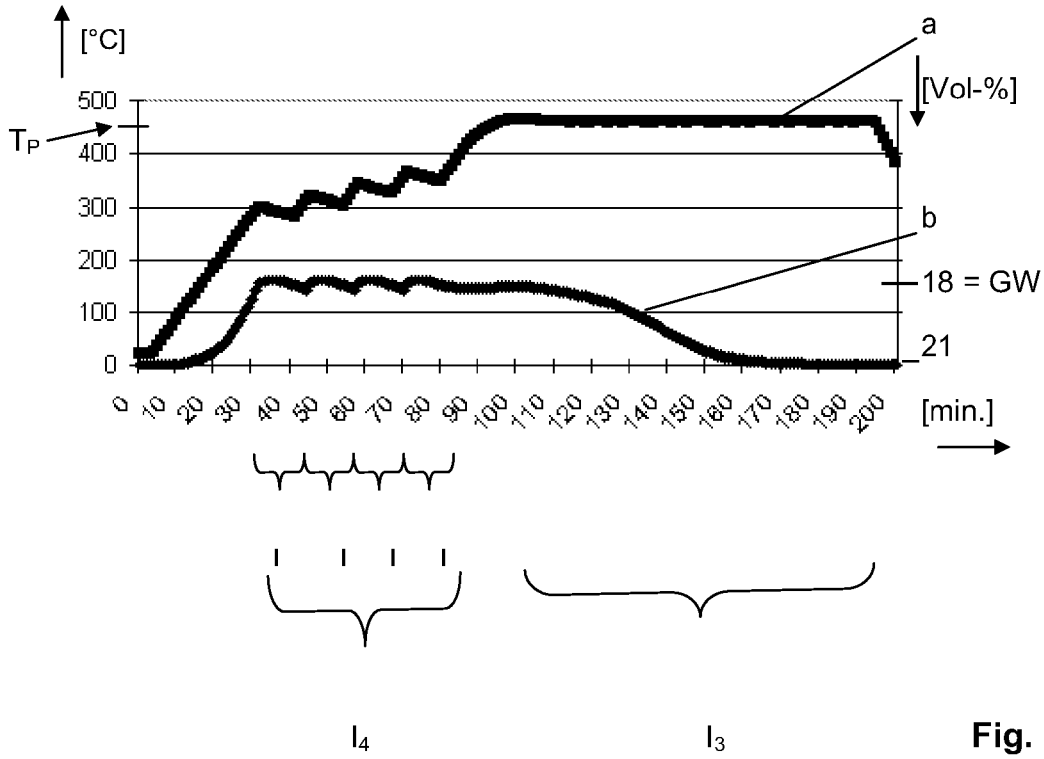
FIG. 3—a diagram of the oven cavity temperature and of the oxygen concentration as a function of time.

FIG. 3 shows the course of the oven cavity temperature a and of the oxygen concentration b as a function of the time, which is plotted on the abscissa in minutes, abbreviated as "min". The oven cavity temperature a is plotted in degrees centigrade, abbreviated "° C.", on the left-hand ordinate. The absolute oxygen concentration is indicated in vol-% on the right-hand ordinate.

In the embodiment shown, the oven exhibits heavy soiling 26. See FIG. 2. The user starts the pyrolysis cleaning procedure by means of the operating elements 6. In this process, the user is prompted and informed via the display 4 in a manner known to the person skilled in the art.

At the beginning of the pyrolysis cleaning procedure, namely, point in time 0 minutes, the oven cavity temperature a is the ambient temperature, that is to say, about 20° C. The oxygen concentration corresponds to the oxygen concentration in the atmosphere, in other words, about 21 vol-%.

During the heating phase, the oven cavity 8 is heated up by means of the heat source 20 in that the electrical control unit 14 alternatingly switches the heat source 20 on and off until a pyrolysis temperature $T_P$ is reached, whereby the heat source 20 is switched on during a first time interval $I_1$ and then switched off during a second time interval $I_2$. The two time intervals $I_1$ and $I_2$ are predefined and stored in the memory 141. As an alternative to this, it is also possible for the oven cavity 8 to be heated at a rate that was predefined and stored in a memory 141 of the electrical control unit 14, namely, approximately 10° C. per minute, so that a heating rate is obtained that is similar to that of the first alternative.

As soon as the oven cavity temperature a is approximately 200° C., the oxygen concentration b in the oven cavity 8 and thus also in the exhaust-air conduit 16 starts to change. The breakdown of the soiling 26 gives rise to smoke gases 17 that are discharged into the atmosphere via the catalyst 22 and the exhaust-air conduit 16. These smoke gases 17 and the resulting products such as hydrogen and carbon dioxide stemming from the oxidation at the oxidation catalyst 22 partially displace the oxygen, so that the oxygen concentration in the oven cavity 8 and in the exhaust-air conduit 16 drops.

The output signal of the oxygen sensor 24 and thus the measured oxygen concentration b are constantly transmitted, at least during the heating phase, to the electrical control unit 14 and then compared in the evaluation circuitry 142 of the electrical control unit 14 to a stored limit value GW for the oxygen concentration b, namely, 18 vol-%. As a function of this and independently of the above-mentioned heating program, which is already under way, in other words, independently of the alternating switching on and off of the heat source 20 during the heating phase, the heat source 20 is switched on and off by the electrical control unit 14. If the oxygen concentration b falls below 18 vol-%, the heat source 20 is switched off for a predefined time interval I that is stored in the memory 141, whereby the time interval I corresponds here to the duration of the second time interval $I_2$. When the oxygen concentration rises again above 18 vol-% after the time interval I has ended, the heat source 20 is switched on once again.

In the example explained here, the oxygen concentration b drops quickly by more than 3 vol-% to below 18 vol-%. Through the constant comparison of the measured oxygen concentration b to the stored limit value GW in the evaluation circuitry 142, the heat source 20, as explained above, is now switched off by the electrical control unit 14 during a time interval I, which can be clearly seen from the drop in the oven cavity temperature a and from the rise in the oxygen concentration b. As soon as the time interval I has ended and the oxygen concentration b is once again above the limit value GW, the heat source 20, as explained above, is switched on once again and operated alternatingly. The oven cavity temperature a rises again and the oxygen concentration b falls again. This above-mentioned cycle is repeated since the oxygen concentration b drops sharply again, namely, to below the limit value GW.

If the oxygen concentration b had still been below the limit value GW at the end of the time interval I, then the electrical control unit 14 would have operated the oven for another time interval I while the heat source 20 was switched off.

The above-mentioned cycle is repeated a total of four times in the example shown here. After the heat source 20 has been once again switched on by the electrical control unit 14 at the end of the time interval I, the heat source 20 remains switched on, so that, in the manner described above, the heat source 20 continues to heat the oven cavity 8 in an alternating operation until the pyrolysis temperature $T_P$ is reached. This is the case because the oxygen concentration b no longer drops below 18 vol-% after the last time the heat source 20 is switched back on, after approximately 80 minutes.

In the embodiment shown here, the above-mentioned heating phase is followed by a holding phase during which a predefined pyrolysis temperature $T_P$ is kept essentially constant through temperature regulation in a manner known to the person skilled in the art, by means of a temperature sensor 30 that is arranged in the oven cavity 8 and that is connected to the electrical control unit 14 so as to transmit signals. In the present embodiment, the duration of the holding phase $I_3$ as well as the pyrolysis temperature $T_P$ during the heating phase and as a function of the oxygen concentration b during the heating phase are determined, which will be explained in greater detail below.

The duration of the holding phase $I_3$ and the pyrolysis temperature $T_P$ are automatically determined here in the evaluation circuitry 142 as a function of the number of times that the heat source 20 was switched off during the heating phase because the oxygen concentration b was too low. Since the heat source 20 was switched off a total of four times during the heating phase because the oxygen concentration b was too low, the duration of the holding phase $I_3$ is automatically selected at the highest value, namely, 90 minutes for the current pyrolysis cleaning procedure, and used for the program sequence. Here, 460° C. is selected for the pyrolysis temperature $T_P$ and used for the program sequence. See FIG. 3.

If the soiling in the oven cavity 8 were less, not as much smoke gas would be generated during the heating phase, so that the above-mentioned monitoring of the oxygen concentration b would cause the heat source 20 to be switched off fewer times. For instance, if the heat source was not switched off at all or only once during the heating phase, in other words, in the case of light soiling 26, then $I_3$=30 min and $T_P$=430° C., and if the heat source was switched off two or three times during the heating phase, that is to say, in the case of moderate soiling 26, then $I_3$=60 min and $T_P$=445° C. are selected for the program cycle.

In the present embodiment, where the end of the heating phase and thus the beginning of the holding phase are dependent on a given pyrolysis temperature $T_P$ being reached in the oven cavity 8 that is automatically determined during the heating phase by means of the oxygen sensor 24 as well as the electrical control unit 14, it is necessary for the method according to the invention to have ended before this pyrolysis temperature $T_P$ has been reached in the oven cavity 8. This is why the method according to the invention is ended here when an oven cavity temperature a of 400° C. has been reached. On the one hand, this already allows a high-quality evaluation and, on the other hand, this temperature is still below the value range for oven cavity temperatures a that are suitable for the pyrolysis. Fundamentally speaking, however, other ending conditions that are suitable and known to the person skilled in the art are likewise conceivable for the method according to the invention. Moreover, in a simpler embodiment, it would also be a possibility to predefine a pyrolysis temperature $T_P$. The method according to the invention can then be carried out independently of the pyrolysis temperature $T_P$.

Instead of the above-mentioned embodiment, it would also be conceivable for the duration of the holding phase $I_3$ and/or the value of the pyrolysis temperature $T_P$ in the oven cavity during the holding phase $I_3$ to be automatically determined in the evaluation circuitry 142 as a function of the average oven cavity temperature during the time interval $I_4$, namely, from the first time the heat source 20 was switched off because the oxygen concentration b was too low until the end of the last time the heat source 20 was switched off because the oxygen concentration was too low b.

Applying this to the present example, the average oven cavity temperature over the time interval $I_4$ would correspond to a value of more than 320° C., and then, if this temperature were present, $I_3$=90 min and $T_P$=460° C. would be selected. In the case of an average oven cavity temperature of less than 300° C., then $I_3$=30 min and $T_P$=430° C. would be selected, and in the case of an average oven cavity temperature of between 300° C. and 320° C., then $I_3$=60 min and $T_P$=445° C. would be selected.

Another alternative refinement proposes for the duration of the holding phase $I_3$ and/or the value of the pyrolysis temperature $T_P$ in the oven cavity 8 during the holding phase $I_3$ to be automatically determined in the evaluation circuitry 142 as a function of the sum of the times when the heat source 20 was switched off during the heating phase because the oxygen concentration b was too low. This can be realized particularly easily in that the sum of the times when the heat source 20 was switched off because the oxygen concentration b was too low is added to a minimum duration $I_{3_MIN}$ that was predefined and stored in the memory 142.

Applying this to the present example, then $I_{3_MIN}$ would be 30 min. Even if only light soiling 26 were present in the oven cavity 8, the holding phase $I_3$=$I_{3_MIN}$ would last 30 min and the pyrolysis temperature $T_P$ would be 430° C. In the case of heavy soiling 26, the time interval I would be longer, corresponding to the sum of the switch-off times and $T_P$=445° C. With heavy soiling 26, as in the example at hand, $I_3$ would be 90 min, namely, $I_{3_MIN}$=30 min+4×15 min.

Once the duration of the holding phase $I_3$ and the pyrolysis temperature $T_P$, that is to say, the oven cavity temperature during the holding phase $I_3$, have been selected for the further program cycle in one of the above-mentioned manners, the oven cavity 8 continues to be heated up as explained above until $T_P$ has been reached. As soon as $T_P$ has been reached, the holding phase $I_3$ begins; a time element integrated into the evaluation circuitry 142 and not presented here is started and after $I_3$ has ended, said time element ends the holding phase with the transition to the cooling phase of the pyrolysis cleaning procedure, which will be elaborated upon below.

As can be seen in FIG. 3, the above-mentioned temperature regulation is employed to keep the oven cavity temperature a essentially constant while the oxygen concentration b drops steadily owing to the reduction in the decomposition products during the reaction of the smoke gases 17 at the oxidation catalyst 22 as the pyrolysis progresses. At the end of the holding phase $I_3$, no reaction takes place any longer, meaning that the oxygen concentration b has once again risen to the value under atmospheric conditions, in other words, about 21 vol-% or 0 vol-% deviation.

At the conclusion of the pyrolysis cleaning procedure, the oven cavity temperature a in the present embodiment is reduced to a final temperature of 70° C. during the cooling phase by means of the above-mentioned temperature regulation. Once this oven cavity temperature a has been reached, the door 10 that had been automatically locked at the beginning of the pyrolysis cleaning procedure is once again unlocked, so that it can be opened by the user without risk. The cooling phase is not depicted in its entirety in FIG. 3.

Whereas the oven cavity temperature a during this phase drops steadily until it reaches the predefined final temperature of 70° C., the oxygen concentration b no longer changes.

The method according to the invention is not restricted to the embodiment shown or to the alternative embodiments presented above. Reference should be had to the appended claims. For instance, it would also be conceivable to employ the method during the entire pyrolysis cleaning procedure, that is to say, during the heating phase, holding phase and cooling phase. It would also be possible to automatically determine and/or to predefine unchanging values for the duration of the holding phase $I_3$ and/or for the pyrolysis temperature $T_P$ during the holding phase $I_3$. The time intervals I through $I_4$ as well as $T_P$ can also be selected within a broad suitable range.

What is claimed is:

1. A method for controlling a pyrolysis cleaning process in an oven, comprising the following steps:

a) heating an oven cavity of the oven by switching on a heat source;

b) measuring, using an oxygen sensor, an oxygen concentration in the oven cavity or in an exhaust-air conduit configured to discharge fumes from the oven cavity;

c) comparing, in an evaluation circuitry of an electrical control unit, the measured oxygen concentration to a predefined limit value stored in a memory;

d) operating, if the measured oxygen concentration drops below the limit value, the oven for a predefined first time interval with the heat source switched off, a duration of the first time interval being stored in the memory; and e) repeating steps b) through d) after the first time interval has ended; or f) repeating steps a) through d) if the measured oxygen concentration is equal to or greater than the limit value.

2. The method as recited in claim 1 further comprising alternately switching on the heat source during predefined second time intervals and then switching off the heat source during third time intervals, a duration of the first time interval being the same as a duration of the third time interval, a duration of the second time intervals being stored in the memory.

3. The method as recited in claim 1 wherein the limit value is about 18 vol-%.

4. The method according to claim 1 wherein the pyrolysis cleaning procedure comprises:

a heating phase performed until a pyrolysis temperature in the oven cavity has been reached, the pyrolysis temperature being either predefined or automatically determined during the heating phase;

a holding phase having a duration corresponding to a fourth time interval, a duration of the fourth time interval being either predefined or automatically determined during the heating phase, the pyrolysis temperature being maintained substantially constant during the holding phase by temperature regulation; and a cooling phase configured to reach a predefined final temperature in the oven cavity;

wherein steps a) through f) are performed only during the heating phase.

5. The method as recited in claim 4 wherein at least one of a duration of the fourth time interval and a value of the pyrolysis temperature during the holding phase is automatically determined in the evaluation circuitry as a function of a number of times the heat source was switched off during the heating phase due to the oxygen concentration falling below the limit value.

6. The method as recited in claim 4 wherein at least one of a duration of the fourth time interval and a value of the pyrolysis temperature during the holding phase is automatically determined in the evaluation circuitry as a function of an average oven cavity temperature during a fifth time interval, the fifth time interval having a duration equal to a time period from a first time the heat source was switched off due to the oxygen concentration falling below the limit value until an end of a last time the heat source was switched off due to the oxygen concentration falling below the limit value.

7. The method as recited in claim 4 wherein at least one of a duration of the fourth time interval and a value of the pyrolysis temperature during the holding phase is automatically determined in the evaluation circuitry as a function of a sum of a number times the heat source was switched off during the heating phase due to the oxygen concentration falling below the limit value.

8. The method as recited in claim 7 wherein the duration of the fourth time interval is determined in the evaluation circuitry by adding a sum of the number of times when the heat source was switched off to a predefined minimum duration stored in the memory.

* * * * *